US009504890B2

(12) United States Patent
Fallon

(10) Patent No.: US 9,504,890 B2
(45) Date of Patent: Nov. 29, 2016

(54) DEVICE FOR REPAIRING A PITCH MARK

(71) Applicant: Conor Fallon, Co Kildare (IE)

(72) Inventor: Conor Fallon, Co Kildare (IE)

(73) Assignee: Sandgroup International Ltd., Causeway Bay (HK)

( * ) Notice: Subject to any disclaimer, the term of this patent is extended or adjusted under 35 U.S.C. 154(b) by 0 days.

(21) Appl. No.: 14/429,085

(22) PCT Filed: Jan. 16, 2014

(86) PCT No.: PCT/EP2014/050778
§ 371 (c)(1),
(2) Date: Mar. 18, 2015

(87) PCT Pub. No.: WO2014/111453
PCT Pub. Date: Jul. 24, 2014

(65) Prior Publication Data

US 2015/0217170 A1 Aug. 6, 2015

(30) Foreign Application Priority Data

Jan. 17, 2013 (IE) ..... S2013/0009

(51) Int. Cl.
*A63B 57/50* (2015.01)
*A63B 57/00* (2015.01)

(52) U.S. Cl.
CPC ..... *A63B 57/0068* (2013.01); *A63B 57/50* (2015.10); *A63B 2209/08* (2013.01); *A63B 2210/50* (2013.01)

(58) Field of Classification Search
CPC ..... A63B 57/50; A63B 57/0037; A63B 2209/08; A63B 2210/50
See application file for complete search history.

(56) References Cited

U.S. PATENT DOCUMENTS 3,049,182 A * 8/1962 Pelow ..... A63B 57/50 172/378
3,061,270 A * 10/1962 Lowe ..... A01B 1/16 172/378
3,415,518 A * 12/1968 Root ..... A63B 57/60 111/99
5,110,123 A * 5/1992 Larson ..... A63B 57/50 172/378
5,706,900 A * 1/1998 Liao ..... A01B 1/14 16/402
6,004,227 A * 12/1999 Petersen ..... A63B 57/0037 294/19.2
6,162,137 A * 12/2000 Jones ..... A24F 13/26 30/109
6,565,458 B1 * 5/2003 Cameron ..... A63B 57/50 473/408
6,699,144 B1 * 3/2004 Kvitek ..... A63B 57/50 473/406
D582,734 S * 12/2008 Murray ..... D8/8

(Continued)

FOREIGN PATENT DOCUMENTS

IE WO 2011117425 A1 * 9/2011 ..... A63B 57/50

*Primary Examiner* — Steven Wong
(74) *Attorney, Agent, or Firm* — Jason T. Daniel, Esq.; Daniel Law Offices, P.A.

(57) ABSTRACT

The present invention provides a device for repairing a pitch mark in a playing surface such as a golf green, the device comprising a head from which projects a plurality of generally parallel prongs of fixed length each having a proximal end and a distal end, and wherein each prong is undulated along its length, the undulations of each prong lying within a respective plane, such that the prongs may be inserted into a pitch mark in a playing surface, where the prongs engage with the material of the playing surface and as the prongs are retracted they act to restore the playing surface by drawing out the pitch mark.

18 Claims, 8 Drawing Sheets

(56) References Cited

U.S. PATENT DOCUMENTS

2004/0192474 A1* 9/2004 Pietsch ..... A63B 57/50
473/387
2004/0219997 A1* 11/2004 Champion ..... A63B 57/50
473/408
2005/0101416 A1* 5/2005 Tiefel ..... A63B 57/207
473/408
2007/0149325 A1* 6/2007 Vargas ..... A63B 57/207
473/408
2008/0220908 A1* 9/2008 Jaffe ..... A63B 57/50
473/406
2011/0201456 A1* 8/2011 Schaaf ..... A63B 57/0068
473/408
2015/0360103 A1* 12/2015 Lattimore ..... A63B 57/50
473/408

* cited by examiner

DEVICE FOR REPAIRING A PITCH MARK

FIELD OF THE INVENTION

This invention relates to devices for repairing pitch marks in a playing surface such as a golf green, caused by the impact of a ball, which device can be quickly and effectively operated with a single hand and in a efficient two stage action.

BACKGROUND OF THE INVENTION

In the game of golf the condition of the golf course can play a significant role in the progress and/or success of a game, with particular emphasis being placed on the condition of the greens, which should have as smooth or uniform a surface as possible in order to ensure that a golf ball travelling across the green with not be disturbed from its intended course, notwithstanding various designed features of the green such as camber, etc. The surface of a green can be damaged or disturbed due to the impact of a golf ball landing, in particular directly, from any significant height, for example when a ball is pitched onto the green. The landing of the ball can produce a depression in the surface of the green, otherwise know as a pitch mark, which can then result in an unintended and unacceptable deviation of a subsequent golf ball rolling across the green over such a depression.

This is a well known and long standing issue in the game of golf, and as a result there are numerous tools and devices which have been developed to enable a golfer or professional greens keeper to repair such pitch marks.

WO 2011/117425 discloses a pitch mark repair tool having a front surface which is applied against the surface of a golf green. A handle is mounted on a body behind the front surface for reciprocal movement towards and away from the front surface, and several prongs are carried by the handle which reciprocate, as the handle is reciprocated, between an extended position wherein the prong extends forwardly of the front surface for penetrating the golf green and a retracted position wherein the prong is at least partially retracted behind the front surface.

The prongs of the devices described in WO 2011/117425 may be straight or may helical, i.e. having a corkscrew shape. In preferred embodiments, the prongs are rotated or screwed into the ground as they pass through the front surface and into the ground, and are then withdrawn without rotation to assist in pulling the earth upwards. In other embodiments, the prongs, whether straight or helical, are driven straight into the ground and withdrawn without any rotation.

SUMMARY OF THE INVENTION

A device for repairing a pitch mark from a golf ball, comprising:

a terminal surface;

a plurality of generally parallel prongs, comprising a minimum of three and a maximum of eight prongs of fixed length each having a proximal end and a distal end, with the proximal ends mounted in the terminal surface;

wherein each prong is undulated along its length, the undulations of each prong lying within a respective plane;

whereby in use the prongs are inserted into a pitch mark in a playing surface, such that the prongs engage with the material of the playing surface and as the prongs are retracted they act to restore the playing surface by reducing the pitch mark.

The device of the invention has been found to provide surprisingly good results due to the undulated prongs which have a different interaction with the ground than either the known helical or straight prongs.

One of the challenges in repairing pitch marks is ensuring that the ground is lifted sufficiently without being overly aggressive and without being ineffectual. It has been found that prongs which have an undulation along their length where the undulations lie within a plane provide the correct amount of "pull" as they are withdrawn from most types of soil encountered.

It has been found that the use of undulating pins which are flat, i.e. lie within a plane, is much kinder to the root and leaf structure of the golf greens than were helical pins, and this is a critical factor in the attractiveness of a device to golfers, green keepers and golf club professionals.

Preferably, the plurality of prongs are arranged in a circular formation

Preferably, the respective plane defined by the undulations of each prong is offset from the radial direction of said circular formation by at least 30 degrees.

More preferably, the offset is 40 degrees or more.

It has been found that where the prongs are arranged with the planes radially pointing to a common centre, the tool may be overly aggressive, with the soil being trapped between two facing undulations and hence an offset such as this provides an improved interaction with the surface.

Preferably, the respective plane defined by the undulations of each prong is offset from the plane of a neighbouring prong in the circular arrangement by at least 60 degrees, more preferably by 80 to 120 degrees, most preferably by about 90 degrees.

Preferably, the device comprises more than four prongs, and the respective plane defined by the undulations of each prong is within 15 degrees of a tangential direction, where the tangential direction is defined on a circle around which the prongs are arranged.

Preferably, the radius of said circular arrangement is between 6 and 10 mm.

Preferably, the number of prongs is four.

Preferably, the undulations describe a waveform of wavelength from 6 to 10 mm.

Preferably, the undulations describe a waveform of amplitude from 2 to 4 mm, more preferably 2.7 to 3.3 mm, and most preferably about 3 mm.

Preferably, the undulations describe a generally sinusoidal waveform or a sawtooth wave with rounded transitions.

Preferably, the prongs are wire-like prongs of diameter from 1 to 3 mm, more preferably from 1.5 to 2 mm.

Preferably, the device comprises a handle by which the device can be grasped for inserting the prongs into a pitch mark in a playing surface.

Preferably, the device comprises a head which defines the terminal surface.

Preferably, the head if formed integrally with the handle.

Preferably, the head is displaceable relative to the handle in a manner which permits the prongs to be displaced between an extended and a retracted state.

Preferably, the head is rotatable between the extended and retracted states.

Preferably, the head is displaceable linearly between the extended and retracted states.

Preferably, the device comprises a biasing mechanism arranged to urge the prongs into the extended state.

Preferably, the biasing mechanism comprises a pair of repulsing magnets.

Preferably, the device comprises a manually operable lock adapted to releasably retain the prongs in the retracted and/or extended state.

Preferably, at least one of the prongs is rotatable about an effective longitudinal axis of said prong and relative to the terminal surface.

BRIEF DESCRIPTION OF THE DRAWINGS

The invention will now be further illustrated by the following description of embodiments thereof, given by way of example only with reference to the accompanying drawings, in which.

DETAILED DESCRIPTION OF THE DRAWINGS

Figure 1:
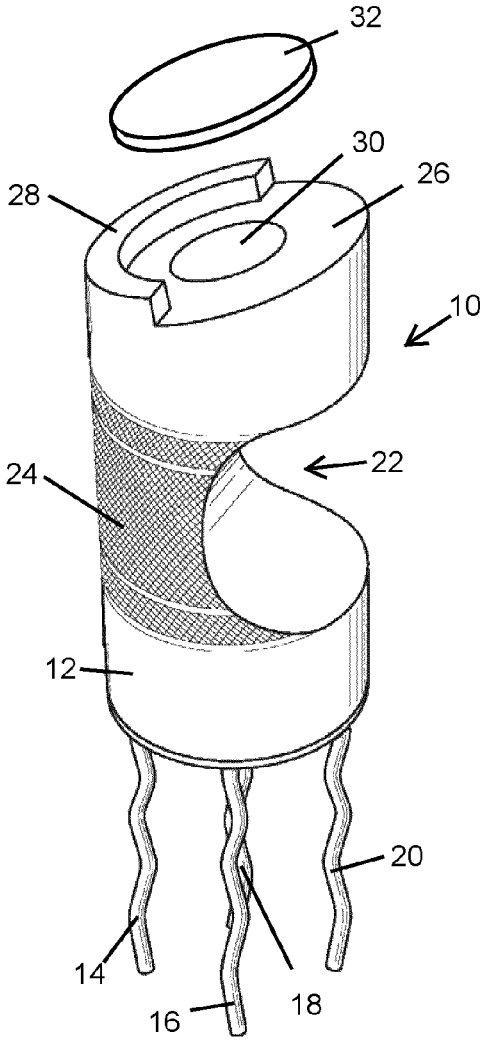
FIG. 1 is a perspective view of a device for repairing pitch marks, taken from above.

In FIG. 1, there is indicated, generally at 10, a device for repairing pitch marks on a golf green or other playing surface. The device comprises a generally cylindrical handle portion 12 having a set of four prongs 14, 16, 18, 20 mounted therein.

Figure 2:
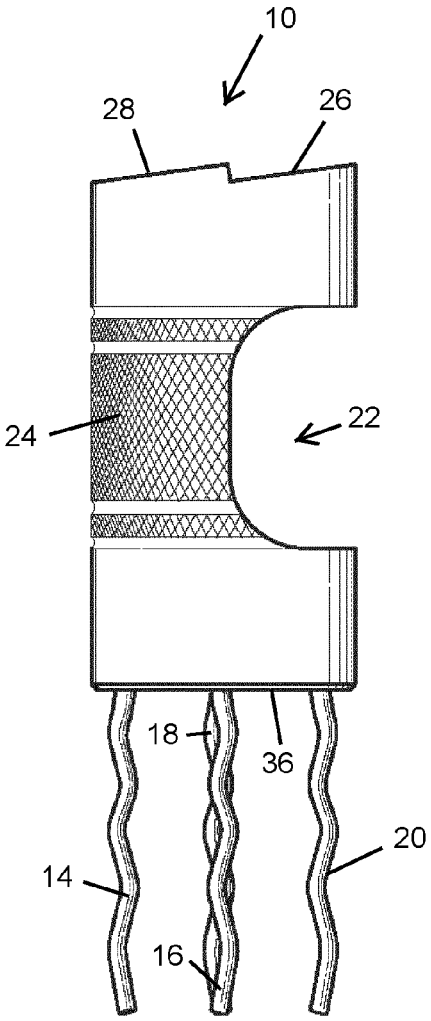
FIG. 2 is a side elevation of the device of FIG. 1.

As also seen in FIG. 2, the generally cylindrical handle portion 12 has a deep recess 22 midway along its length providing a finger or thumb grip to assist in pulling the handle from the ground when inserted. A knurled surface 24 runs around a portion of the cylindrical handle to further aid in gripping the device.

Figure 3:
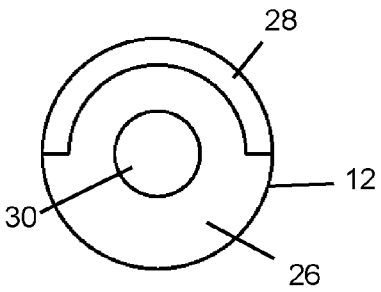
FIG. 3 is a top plan view of the device of FIG. 1.

Referring also to FIG. 3, the top surface 26 is slanted with a raised rim 28 extending around a portion of the circumference. A recess 30 is adapted to permanently receive a similarly sized cylindrical magnet (not shown) chosen to be of a height so that the magnet will protrude slightly above the surface 26 when fitted. A ball marker 32 (FIG. 1 only) is sized to fit within the raised rim and on top of the magnet (not shown) so that it is held in place by magnetic attraction. With the magnet fitted and the ball marker in place, pressing down the edge of the marker at a point 34 opposite the raised rim 28 will tip the marker and release it from the magnet allowing it to be used to temporarily mark the position of a ball.

Figure 4:
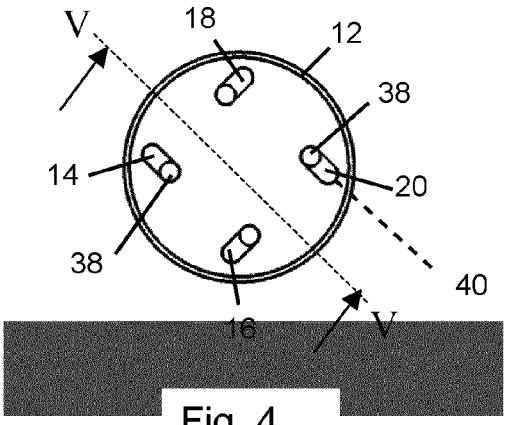
FIG. 4 is a bottom plan view of the device of FIG. 1.

Referring additionally to FIG. 4, it can be seen that the prongs 14, 16, 18, 20 are mounted in a terminal or bottom surface 36, generally parallel to one another (as can be seen from FIG. 2). Each prong is undulated along its length and terminates at a tip 38. Thus when viewed from below as in FIG. 4 it can be seen that the undulations of each prong lie within a respective plane, with the plane of prong 20 indicated by a broken line 40. Thus, the plane 40 of prong 20 is parallel to that of prong 14, with the tips 38 of both prongs pointing in opposite directions, so that the tip 38 of prong 20 points in the direction of prong 18 when viewed from below, and the tip 38 of prong 14 pointing in the direction of prong 16 when viewed from below.

The other prongs 16, 18 have their undulations defined in parallel planes which are perpendicular to those of prongs 14, 20, and again each has its tip pointing in an opposite direction viewed from below.

Each prong's plane is therefore offset from the radial direction by 45 degrees and offset from its neighbours' planes by 90 degrees.

Figure 5:
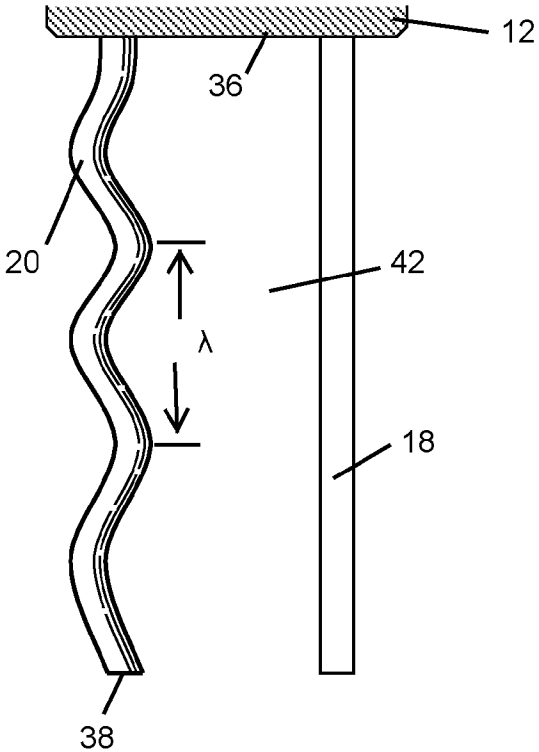
FIG. 5 is a partial sectional elevation of the device of FIG. 1, taken along the line V-V in FIG. 4.

This has the result, as seen in FIG. 5, which shows a detail of the device when viewed along the line V-V from FIG. 4, that the space 42 directly between a pair of neighbouring prongs 18, 20 is captured on one side by the undulating surface of a prong 20, and on the other side by the flat surface of a prong 18 due to the undulations of that latter prong 18 lying in a plane perpendicular to the page and to the plane of prong 20. As a result, the action of the prongs is not as aggressive as would otherwise be the case.

Indicated in FIG. 5 are certain optimal dimensions for the prong. The prongs have a generally (though not strictly) sinusoidal shape when viewed from the side, although a more angular, zig-zag shape can also be employed (i.e. sawtooth wave, but preferably with rounded transitions). The wavelength, $\lambda$, is preferably in the range 6-10 mm. More preferably it is 7-9 mm, and most preferably it is approximately 8 mm (i.e. 7.5 to 8.5 mm).

The amplitude A is preferably from 2 to 4 mm, more preferably 2.7 to 3.3 mm, and most preferably about 3 mm (i.e. 2.9 to 3.1 mm). It will be appreciated that the amplitude here is describing the transverse distance from the extreme surface at one undulation to the opposed extreme surface of the next undulation, and unlike a regular sinusoidal line which has a zero width, part of this dimension A accounts for the thickness of the wire used to create the prong. That thickness, i.e. the wire diameter, is preferably 1.5 to 2 mm.

The length of the prongs from the terminal surface 36 to the tip 38 is preferably in the range 20-36 mm; more preferably 25-30 mm. The currently preferred length of the prongs in the illustrated embodiment is 28 mm.

Figure 7:
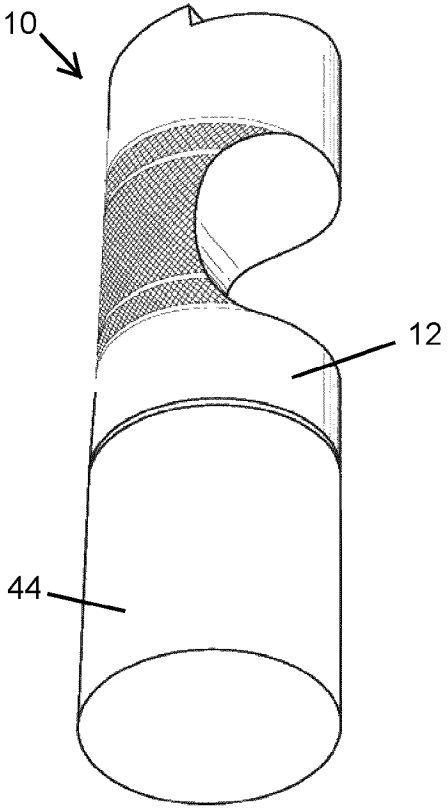
FIG. 7 is a perspective view of the device of FIG. 1 with a cap in place, taken from below.
Figure 6:
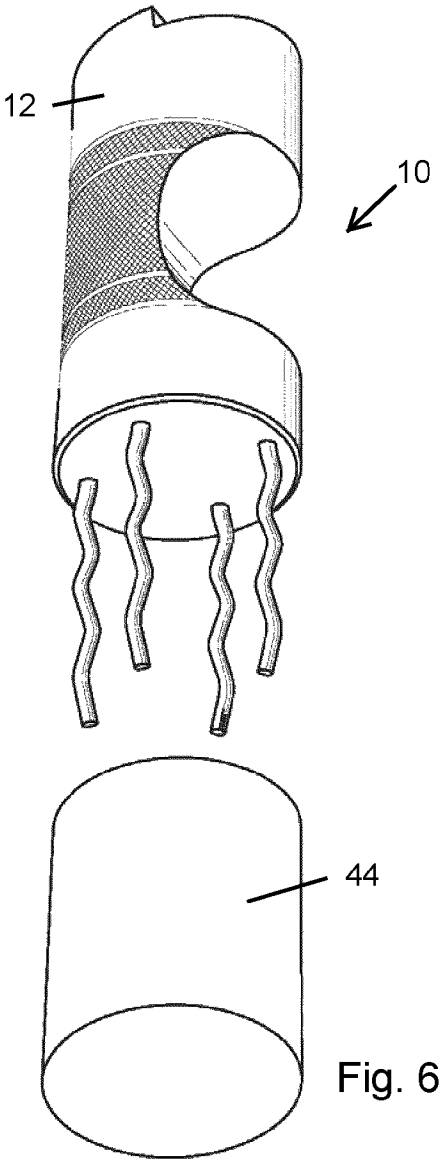
FIG. 6 is a perspective view of the device of FIG. 1 with a cap having been removed, taken from below.

The prongs are disposed around a circle which is of radius preferably in the range 6-10 mm. More preferably it is 7-9 mm, and most preferably it is approximately 8 mm (i.e. 7.5 to 8.5 mm). FIGS. 6 and 7 show the device 10 in perspective view from below, with the addition of a protective cap 44 which is shown both removed from (FIG. 6) and fitted to (FIG. 7) the device 10. With the cap 44 in place the prongs are covered and the device can be carried safely and comfortably in a user's pocket.

Figure 8:
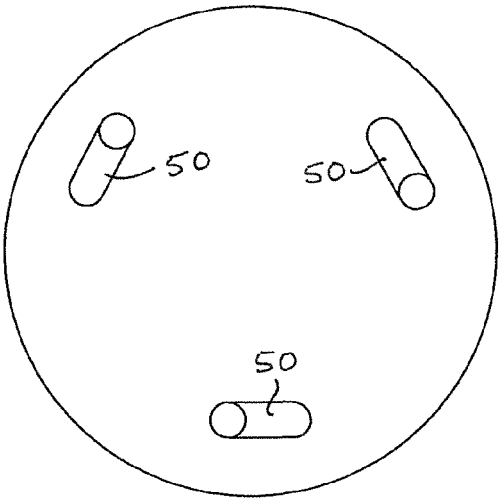
FIGS. 8-10 are plan views from below of alternative embodiments having respectively three, five and six prongs.

FIG. 8 shows an end view of the terminal surface of a further embodiment, similar to the view of FIG. 4, but where the device is provided with three prongs 50. The prongs in a preferred embodiment of three-prong device are arranged equilaterally with an offset between the planes of neighbouring prongs of 120 degrees. The plane of each prong is offset from the radial direction by 90 degrees. While this set-up is more aggressive than that of FIG. 4, the smaller number of prongs may require a greater gripping force between neighbouring prongs.

Figure 9:
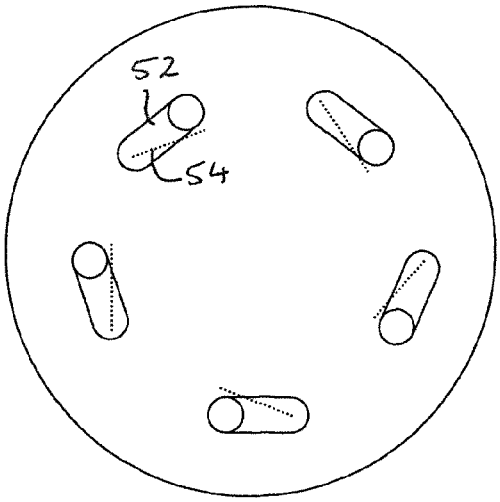

FIG. 9 shows a five prong device, taken in a similar view to FIG. 8. In this case the prongs 52 are arranged at the vertices of a pentagon and perpendicular to the radial direction. If desired and depending on the conditions in which the device is most often used, the dimensions of the prongs and their spacing, the angular arrangement of the prongs can be adjusted so that each points inwards such as is shown for each prong by the superimposed dotted line 54.

Figure 10:
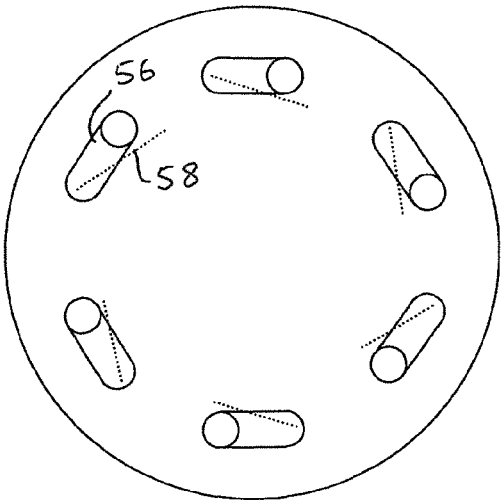

FIG. 10 shows a six prong device, again taken in a similar view. As with FIG. 5, the prongs 56 are arranged at a tangential angle, perpendicular to the radial direction, and in this case at the interstices of a regular hexagon. The prongs could alternatively, if desired be angled more inwardly, as indicated by the dotted lines 58.

Figure 11:
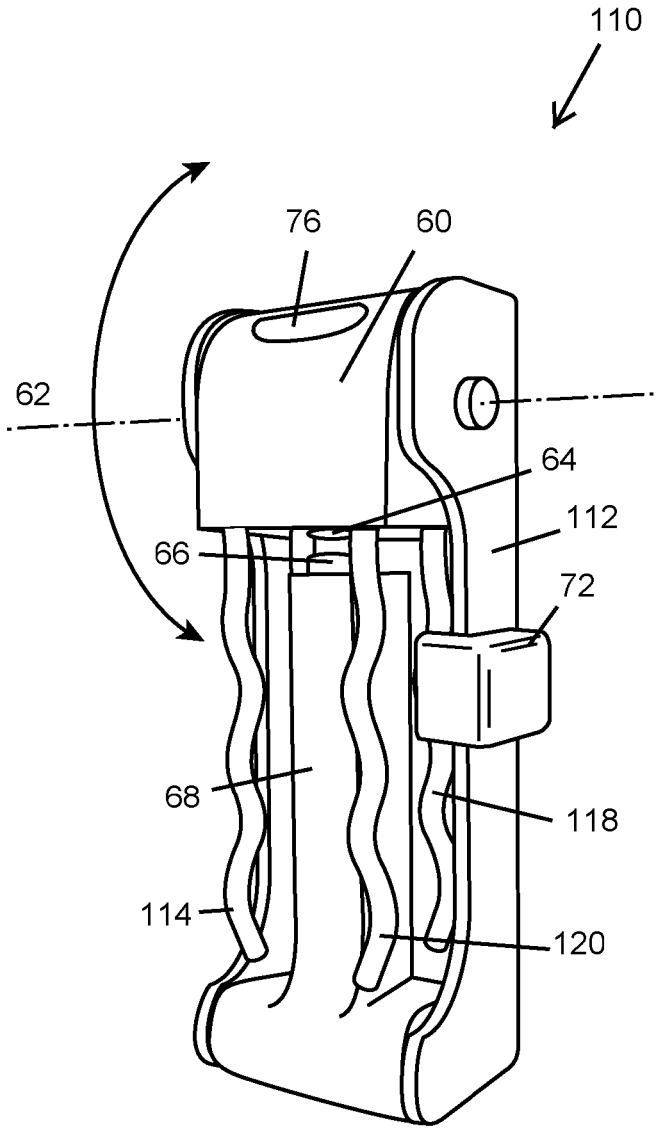
FIG. 11 is a perspective view of a further alternative embodiment of a device for repairing pitch marks according to the present invention, in a retracted or storage state.
Figure 12:
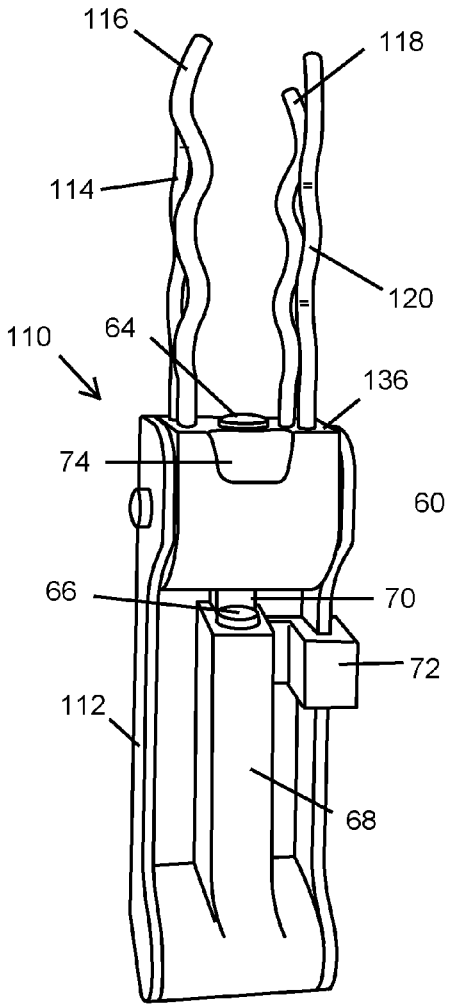
FIG. 12 is a perspective view of the device of FIG. 11 in an extended or use state.
Figure 13:
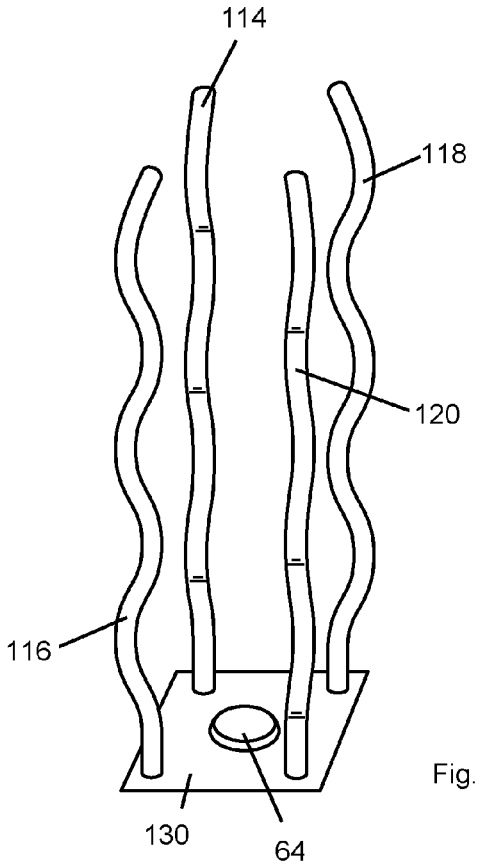
FIG. 13 is a perspective view of a set of prongs forming part of the device of FIGS. 11 and 12.

Referring now to FIGS. 11 to 13 there is illustrated an alternative embodiment of a device for repairing a pitch mark according to the present invention, and generally indicated as 110. In this alternative embodiment like components have been accorded like reference numerals and unless otherwise stated perform a like function. The device 110 comprises a handle 112 which is shaped such as to define a hollow or enclosure therein, within which a set of four prongs 114, 116, 118, 120 may be located or housed as illustrated in FIG. 11, in a storage state, and which may then be displaced into an extended or use state as illustrated in FIG. 12, and as described in detail hereinafter. The prongs 114, 116, 118, 120 are mounted in and extend from a terminal surface 136 which is defined by one side of a head 60 which is captured within and rotatable relative to the handle 112 about an axis of rotation 62. In this way the head 60, carrying the prongs 114, 116, 118, 120, can be rotated about the axis 62 between the storage state illustrated in FIG. 11 and the extended state illustrated in FIG. 12, at which point the prongs 114, 116, 118, 120 may be utilised as hereinbefore described with reference to the previous embodiment to repair a pitch mark.

The device 110 preferably comprises a biasing mechanism in the form of a pair of repulsing magnets, namely a first magnet 64 mounted in or to the terminal surface 136 and a second magnet 66 mounted on a support 68 located within the hollow defined by the handle 112, and at a position such that with the head 60 located such that the prongs 114, 116, 118, 120 are in the storage state the magnets 64, 66 are in opposing alignment with one another in order to generate a repulsing force therebetween. The magnet 64, 66 are positioned to be slightly offset to one another with respect to the direction of rotation of the head 60 such that the repulsing force acts to urge the head 60, and therefore the prongs 114, 116, 118, 120, from the storage state shown in FIG. 11 towards the extended or deployed state illustrated in FIG. 12. It will of course be understood that the pair of magnets 64, 66 could be replaced with any other suitable alternative which acts to bias or urge the head 60 and prongs 114, 116, 118, 120 towards the extended state, for example a spring or the like.

The device 110 further preferably comprises a manually operable lock to releasably retain the head 60 and therefore the prongs 114, 116, 118, 120 in the retracted and/or extended state, as described hereinafter. The lock comprises a latch member 70 which is linearly displaceable by means of a trigger 72 mounted on one side of the handle 112, such that a tip or free end of the latch member 70 may be inserted into or withdrawn from a first keeper 74 formed in one side of the head 60, and a second keeper 76 formed in an opposed side of the head 60. With the head 60 rotated such that the prongs 114, 116, 118, 120 are in the retracted or storage state the latch member 70 is engagable in the first keeper 74, which is shown exposed in FIG. 12, in order to retain the head 60 in this retracted state. To then release the prongs 114, 116, 118, 120 for rotational displacement into the extended or use state, the trigger 72 may be slid downwardly along the body 112 away from the head 60, such that the latch member 70 is drawn out of the first keeper 74.

At this point the repulsing force between the magnets 64, 66 will cause the head 60 and therefore the prongs 114, 116, 118, 120 to rotate around into the extended state as illustrated in FIG. 12. The trigger 72 may then be manually displaced or spring biased towards the head 60 such that the latch member 70 engages in the second keeper 76 in order to retain the head 60 and prongs 114, 116, 118, 120 in the extended state. At this point the device 110 can then be operated as hereinbefore described with reference to the previous embodiment. Once a pitch mark has been repaired the trigger 72 may be operated to allow the head 60 to be manually or otherwise rotated back into the storage state.

Figure 14:
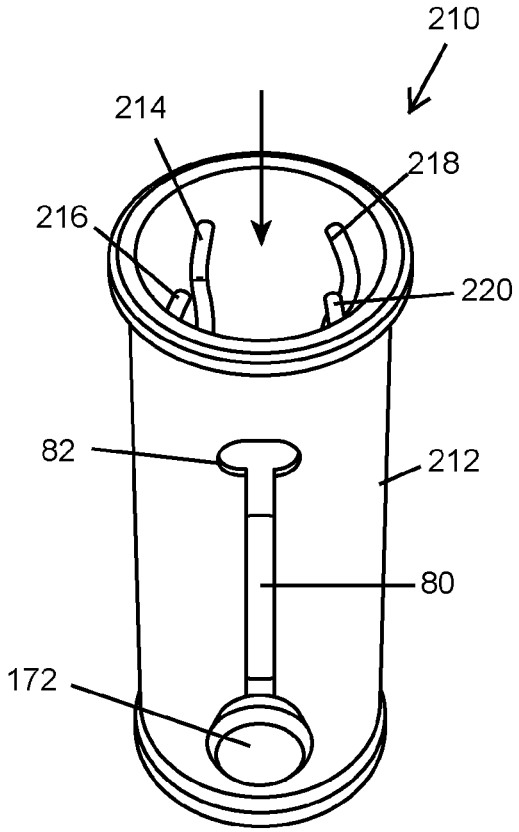
FIG. 14 is a perspective view of an additional embodiment of a device for repairing pitch marks according to the present invention, in a retracted or storage state.
Figure 15:
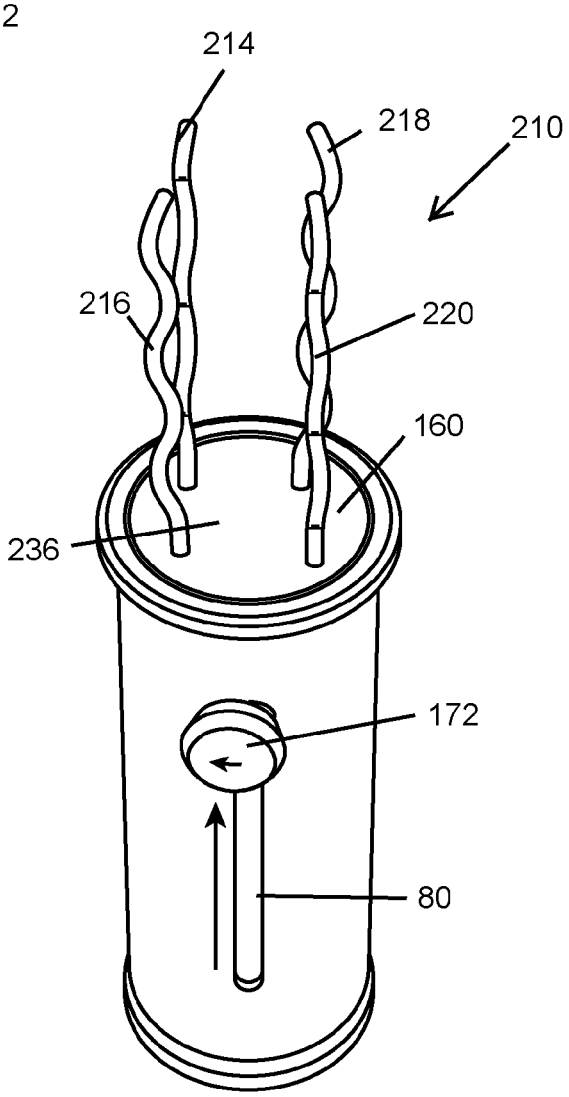
FIG. 15 is a perspective view of the device of FIG. 15 in an extended or use state.

Referring to FIGS. 14 and 15 there is illustrated a further alternative embodiment of a device for repairing a pitch mark according to the present invention, and generally indicated as 210. In this embodiment like components have been accorded like reference numerals and unless otherwise stated perform a like function. The device 210 comprises a hollow cylindrical or tubular handle 212 within which are locatable prongs 214, 216, 218, 220 and which are displaceable between a retracted or storage state as illustrated in FIG. 14 and an extended or use status illustrated in FIG. 15 in which the prongs 214, 216, 218, 220 are displace at least partially out of the handle 212. The prongs 114, 116, 118, 120 extend from a terminal surface 136 defined by a head 160 which is shaped and dimensioned to be located within the hollow tubular enclosure defined by the handle 212 and displaceable linearly along a longitudinal axis of the handle 212 in the manner of a cylinder and piston type arrangement. The dimensional tolerances of the internal bore of the handle 212 and the head 160 are chosen to ensure that the head 160 can be displaced with minimal resistance. One or more bearings, for example detent balls spring mounted between the head 160 and the inner sidewall of the handle 212 may be provided to prevent the head 160 from binding against the inner sidewall during displacement of the head 160.

In order to permit the manual displacement of the head 160 and prongs 114, 116, 118, 120 between the retracted and extended states the device 210 comprises a trigger 72 located on an exterior of the handle 212 and connected through a longitudinally extending slot 80 to the head 160. In this way a user may grasp the handle 212 and use their thumb or other digit to move the trigger 172 longitudinally along the slot 80 such that the prongs 114, 116, 118, 120 and head 160 are displaced between the retracted and extended states. One end of the slot 80 is preferably provided with a laterally extending recess 82 into which the trigger 172 may be displaced in order to effectively lock the trigger 72 from displacement along the slot 80. This allows the head 160 and prongs 114, 116, 118, 120 to be locked in the extended state to prevent the head 160 and prongs 114, 116, 118, 120 from being inadvertently pushed inwardly towards the retracted state as the device 210 is pressed into a pitch mark.

Figure 16:
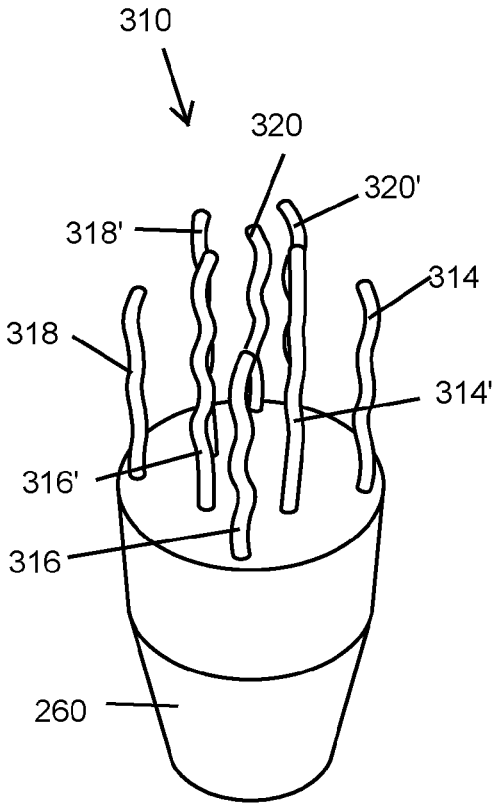
FIG. 16 is a perspective view of a still further embodiment of a device for repairing pitch marks according to the present invention disconnected with an elongate handle detached and omitted.
Figure 17:
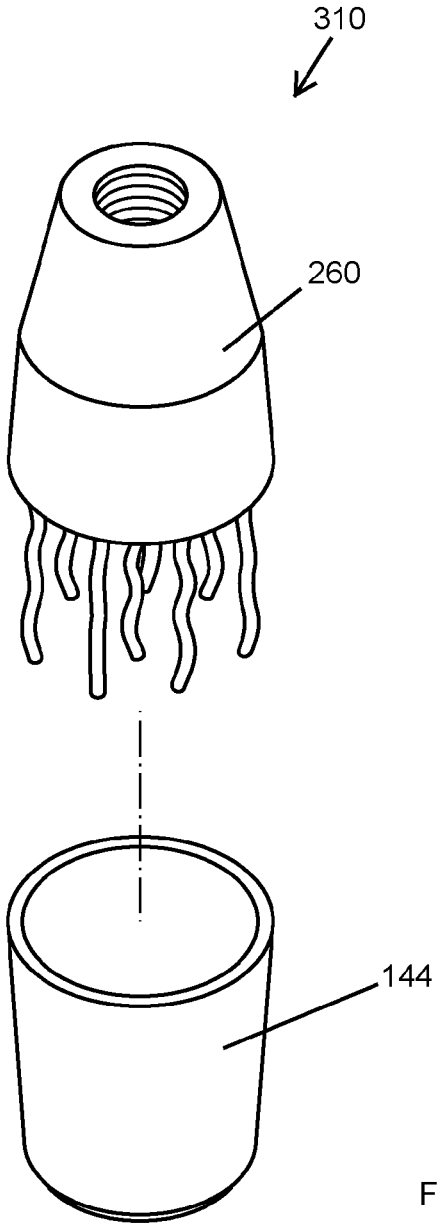
FIG. 17 is a perspective view of the device of FIG. 16.
Figure 18:
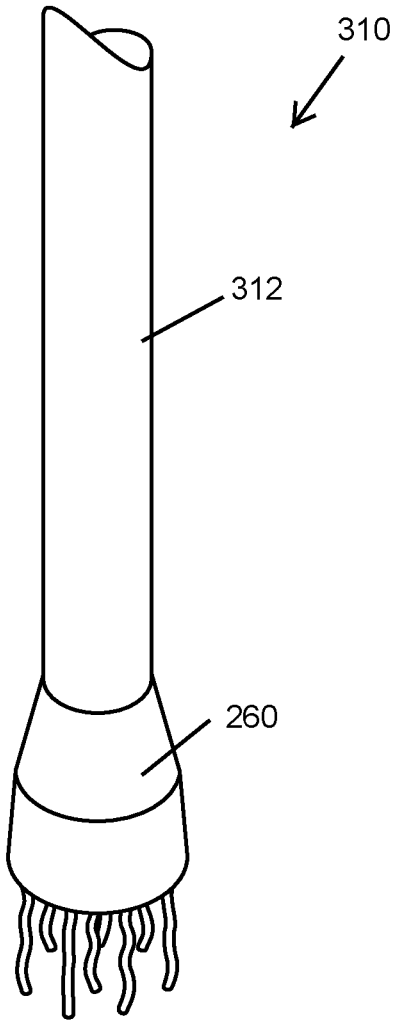
FIG. 18 is a perspective view of the device of FIGS. 16 and 17 with the elongate handle attached to a head of the device.

Turning to FIGS. 16 to 18 there is illustrated a further embodiment of a pitch mark repair device according to the present invention, generally indicated as 310. In this embodiment like components have been accorded like reference numerals and unless otherwise stated perform a like function. The device 310 is intended for use by a professional greens keeper or the like and comprises an elongate shaft like handle 312 to which is preferably releasably mounted, via for example a threaded connection or the like, a head 260 which carries eight prongs 314, 316, 318, 320, 314', 316', 318', 320' which are secured in and project outwardly from a terminal surface 336 forming an end of the head 260.

The elongate handle 312 allows the prongs 314, 316, 318, 320, 314', 316', 318', 320' to be inserted into a pitch mark while the greens keeper remains in an essentially upright position, thereby avoiding the requirement to have to bend down to operate the device 310. This is particularly advantageous for a professional greens keeper or the like who will be required to insert and retract the device 310 into multiple pitch marks on multiple greens during an average working day. By avoiding the requirement to have to bend down to operate the device 310 significant time savings are achieved, in addition to providing a health and safety benefit by avoiding repeated bending down, which can have a negative impact on a persons back or other body parts. The handle 312 may be telescopic or otherwise adjustable in length to allow the overall dimensions of the device 310 to be altered to suit the particular user.

In this embodiment the device 310 preferably comprises eight prongs 314, 316, 318, 320, 314', 316', 318', 320' in order to generate a more aggressive action in use, which thus facilitates a speedier operation of the device 310, again providing a benefit to the professional user such as a greens keeper.

The device 310 may be provided with a cap 144 releasably locatable over the prongs 314, 316, 318, 320, 314', 316', 318', 320' in order to protect same when not in use, as the device 310 is likely to be stored in a tool shed or the like and the relatively delicate prongs 314, 316, 318, 320, 314', 316', 318', 320' could be damaged if not protected.

It will be appreciated that the spacing and angular arrangement of the prongs can be varied as desired to achieve the optimum balance between gripping the soil and root structure to pull the surface upwards and restore a pitch mark to a flat condition, and avoiding pulling the soil too hard and causing damage. To this end one or more of the prongs may be rotated about an effective longitudinal axis of the respective prong and relative to the terminal surface from which the prongs extend, in order to facilitate adjustment of the relative orientation of the prongs to one another and thus the level of grip generated by the prongs when inserted into the soil and root structure of the playing surface.

The invention claimed is:

1. A device for repairing a pitch mark from a golf ball, comprising:

a handle having a body that includes an outside surface and an interior space;

a head which defines a terminal surface, said head being disposed within the interior space of the handle body;

a plurality of generally parallel prongs, each having a proximal end and a distal end, with the proximal ends mounted in the terminal surface, wherein each prong is undulated along its length, the undulations of each prong lying within a respective plane;

wherein the head is displaceable relative to the handle in a manner which permits the prongs to be displaced between an extended and a retracted state, whereby in use the prongs are inserted into a pitch mark in a playing surface, such that the prongs engage with the material of the playing surface and as the prongs are retracted they act to restore the playing surface by reducing the pitch mark, and wherein the head is displaceable linearly between the extended and retracted states.

2. A device according to claim 1 in which the plurality of prongs are arranged in a circular formation.

3. A device according to claim 2 in which a respective plane defined by the undulations of each prong is offset from a radial direction of said circular formation by at least 30 degrees.

4. A device according to claim 3 in which the offset is 40 degrees or more.

5. A device according to claim 3 in which the respective plane defined by the undulations of each prong is offset from a plane of a neighboring prong in the circular arrangement by an amount of between approximately 60 degrees and 90 degrees.

6. A device according to claim 1, further comprising:

more than four prongs, a respective plane defined by the undulations of each prong is within 15 degrees of a tangential direction, where the tangential direction is defined on a circle around which the prongs are arranged.

7. A device according to claim 6 in which the radius of said circular arrangement is between 6 and 10 mm.

8. A device according to claim 1 in which the undulations describe a waveform wavelength between approximately 6 mm and 10 mm, and an amplitude from between approximately 2 mm.

9. A device according to claim 8 in which the undulations describe a generally sinusoidal waveform or a sawtooth wave with rounded transitions.

10. A device according to claim 1 in which the prongs are wire-like prongs having a diameter from between approximately 1 mm to 2 mm.

11. A device according to claim 1, further comprising:

a biasing mechanism arranged to urge the prongs into the extended state.

12. A device for repairing a pitch mark from a golf ball, comprising:

a handle having a body that includes an outside surface and an interior space;

a head which defines a terminal surface, said head being disposed within the interior space of the handle body;

a plurality of generally parallel prongs, each having a proximal end and a distal end, with the proximal ends mounted in the terminal surface, wherein each prong is undulated along its length, the undulations of each prong lying within a respective plane;

wherein the head is displaceable relative to the handle in a manner which permits the prongs to be displaced between an extended and a retracted state; and a biasing mechanism arranged to urge the prongs into the extended state, said biasing mechanism comprising a pair of repulsing magnets, whereby in use the prongs are inserted into a pitch mark in a playing surface, such that the prongs engage with the material of the playing surface and as the prongs are retracted they act to restore the playing surface by reducing the pitch mark.

13. A device according to claim 1 in which the head is rotatable between the extended and retracted states.

14. A device according to claim 1, further comprising:

a manually operable lock adapted to releasably retain the prongs in the retracted and/or extended state.

15. A device according to claim 1 in which a respective plane defined by the undulations of each prong is offset from a neighboring prong by at least 30 degrees.

16. A device according to claim 15 in which the offset is 40 degrees or more.

17. A device according to claim 15 in which the respective plane defined by the undulations of each prong is offset from a plane of a neighboring by an amount of between approximately 60 degrees and 90 degrees.

18. A device for repairing a pitch mark from a golf ball, comprising:

a handle having a body that includes an outside surface and an interior space;

a head which defines a terminal surface, said head being disposed within the interior space of the handle body;

a plurality of generally parallel prongs, each having a proximal end and a distal end, with the proximal ends mounted in the terminal surface, wherein each prong is undulated along its length, the undulations of each prong lying within a respective plane;

wherein the head is displaceable relative to the handle in a manner which permits the prongs to be displaced between an extended and a retracted state, whereby in use the prongs are inserted into a pitch mark in a playing surface, such that the prongs engage with the material of the playing surface and as the prongs are retracted they act to restore the playing surface by reducing the pitch mark, and wherein the plurality of prongs are arranged in a circular formation.

* * * * *